US006733013B1

(12) United States Patent
Bartels et al.

(10) Patent No.: US 6,733,013 B1
(45) **Date of Patent: *May 11, 2004**

(54) LASER GUN FOR AN ARCADE GAME

(75) Inventors: David Bartels, New Smyrna Beach, FL (US); Jack D. Cook, II, Ormond Beach, FL (US); David A. Wise, Daytona Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 7 days.

This patent is subject to a terminal disclaimer.

(21) Appl. No.: 10/320,849

(22) Filed: Dec. 16, 2002

Related U.S. Application Data

(63) Continuation of application No. 09/992,243, filed on Nov. 14, 2001, now Pat. No. 6,536,771.

(60) Provisional application No. 60/248,291, filed on Nov. 14, 2000.

(51) Int. Cl.[7] ..... A63F 9/14

(52) U.S. Cl. ..... 273/349; 273/445; 124/56

(58) Field of Search ..... 273/440, 445, 273/457, 454, 459, 460, 349, 148 R; 463/58; 124/58, 56, 70, 71, 1

(56) References Cited

U.S. PATENT DOCUMENTS

| | | | | |
|---|---|---|---|---|
| 5,480,148 | A | 1/1996 | Bartosik | 273/349 |
| 5,566,950 | A | 10/1996 | Senna | 273/349 |
| 5,573,243 | A | 11/1996 | Bartosik | 273/349 |
| 5,893,562 | A | 4/1999 | Spector | 273/349 |
| 5,954,338 | A | 9/1999 | Hampton | 273/349 |
| 6,007,429 | A | 12/1999 | Lubniewski | 273/371 |
| 6,095,526 | A | 8/2000 | Cook, II | 273/349 |
| 6,422,566 | B1 | 7/2002 | Rudell et al. | 273/445 |
| 6,536,771 | B2 * | 3/2003 | Bartels et al. | 273/349 |

OTHER PUBLICATIONS

Bartels et al., U.S. patent application, Publication No. 2002–009811.

"How the free–electron laser works" by David F. Salisbury, Oct. 9, 2001, found at www.vanderbilt.edu/exploration/news/news_fel_works.htm.

* cited by examiner

*Primary Examiner*—Raleigh W. Chiu
(74) *Attorney, Agent, or Firm*—Standley Law Group LLP

(57) ABSTRACT

Disclosed is a laser gun for an arcade game. The laser gun may additionally provide a method of illumination of the laser path. Illumination may be accomplished by water mist in the path of the laser. The illuminated laser path provides a visible path for the contestants and provides an aesthetically pleasing effect.

10 Claims, 5 Drawing Sheets

LASER GUN FOR AN ARCADE GAME

PRIORITY STATEMENT

This application is a continuation of U.S. application Ser. No. 09/992,243 filed Nov. 14, 2001, now issued U.S. Pat. No. 6,536,771 which claims priority benefits from U.S. Provisional Patent Application Serial No. 60/248,291 filed Nov. 14, 2000, both of which are incorporated herein by reference.

SUMMARY AND BACKGROUND OF THE INVENTION

The present invention relates to the general field of arcade games, and more particularly, a laser gun for an arcade game.

The present invention is comprised of a laser gun for an arcade game. The laser gun may additionally provide a method of illumination of the laser path. Illumination may be accomplished by water mist in the path of the laser. The illuminated laser path provides a visible path for the contestants and provides an aesthetically pleasing effect.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAIL DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
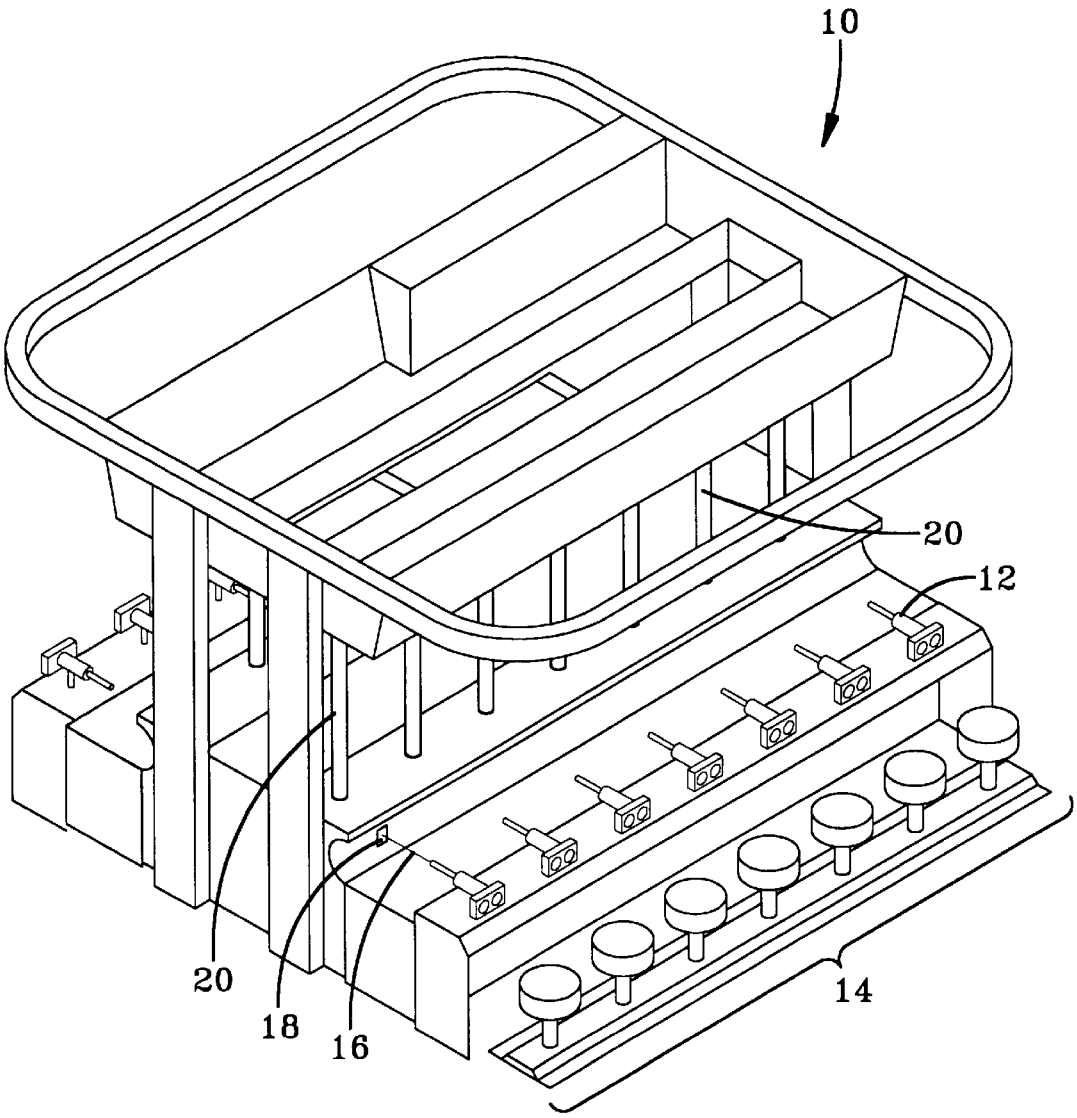
FIG. 1 illustrates one embodiment of an arcade game.

With reference to FIG. 1, one embodiment of an arcade game 10 is shown. The arcade game is a racing type arcade game where the contestants race other contestants. The contestants operate guns 12 at the operator stations 14. The contestants shoot a projectile 16, e.g., water, laser, light, air, bullet, toward the target 18. If the target is hit, race indication device 20 is actuated to indicate race progression. The first contestant to have their race indication device reach a predetermined progress level is deemed the winner of the race. Generally, the winner of the game wins a prize of their choice. In alternative embodiments, the race indication device may be incorporated by using a rising water column, a rising column, a rising game piece or any other indicator of progress.

Figure 2C:
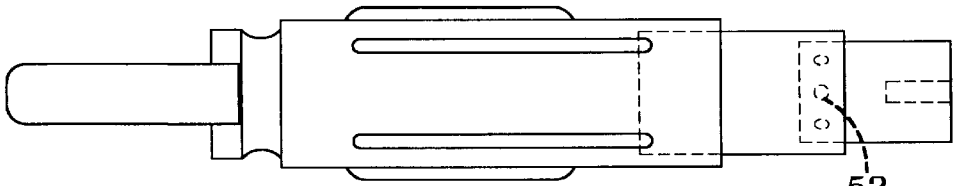
FIGS. 2A–2C illustrate multiple views of one embodiment of the laser gun assembly of the present invention.
Figure 2B:
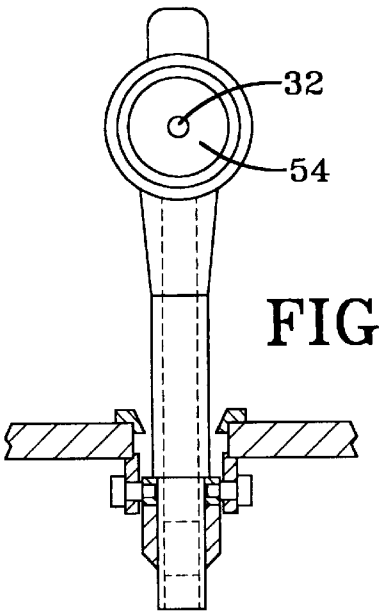
Figure 2A:
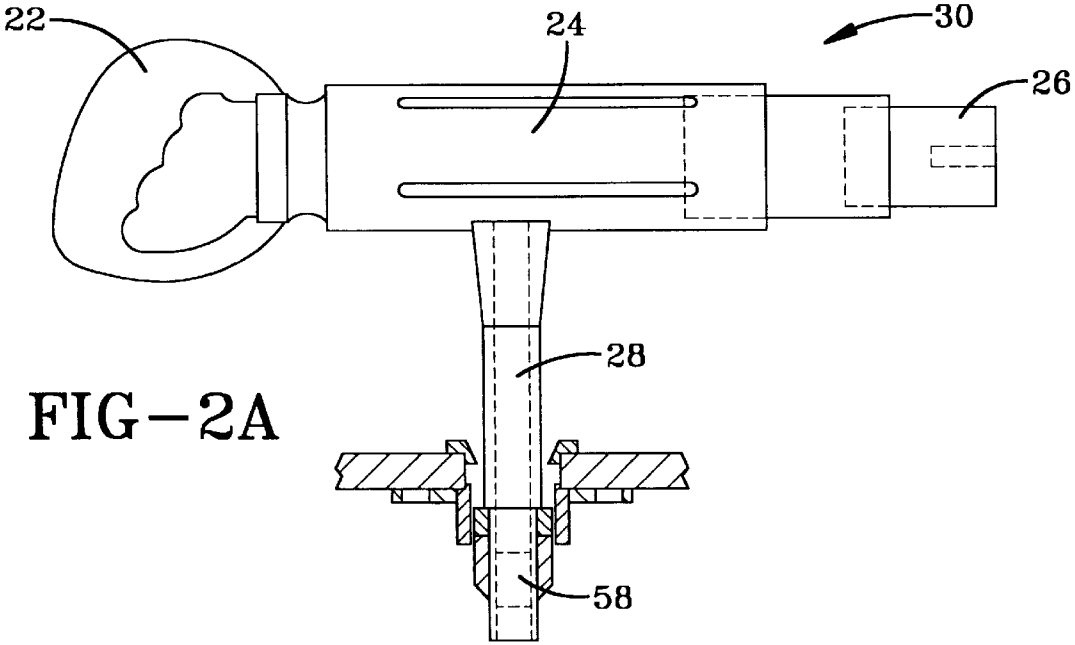

FIGS. 2A–2C illustrate multiple views of one embodiment of the laser gun assembly of the present invention. FIG. 2A is a side elevational view. FIG. 2B is a front elevational view. FIG. 2C is a top plan view. The laser gun assembly 30 is preferably comprised of a handle 22, a main body assembly 24, nozzle 26 and gun stand 28. In an alternative embodiment, the handle may be located at the bottom of the main body assembly.

Figure 3:
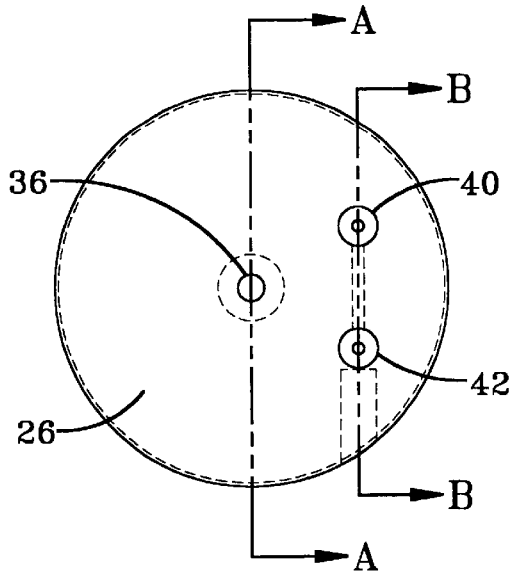
FIGS. 3–3B illustrate cross-sectional views of one embodiment of the nozzle of the present invention.
Figure 3A:
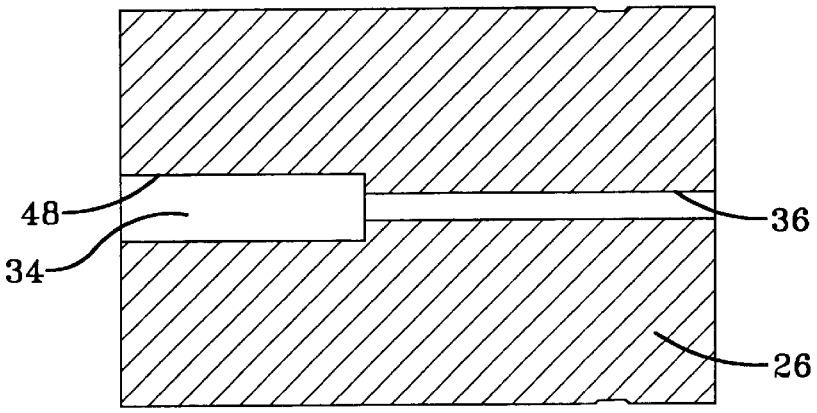

FIG. 3A illustrates a cross-sectional view of one embodiment of the nozzle of the present invention. Taken along cross-section A—A, FIG. 3A illustrates the cavity 34 in the nozzle for holding the laser 32. In an alternative embodiment, the laser cavity may be placed in the rear of the nozzle and where the laser shoots through the narrow hole in the nozzle toward the front of the nozzle. The narrow hole 36 in the embodiment of FIG. 3A may be used to hold electrical wires.

Figure 3B:
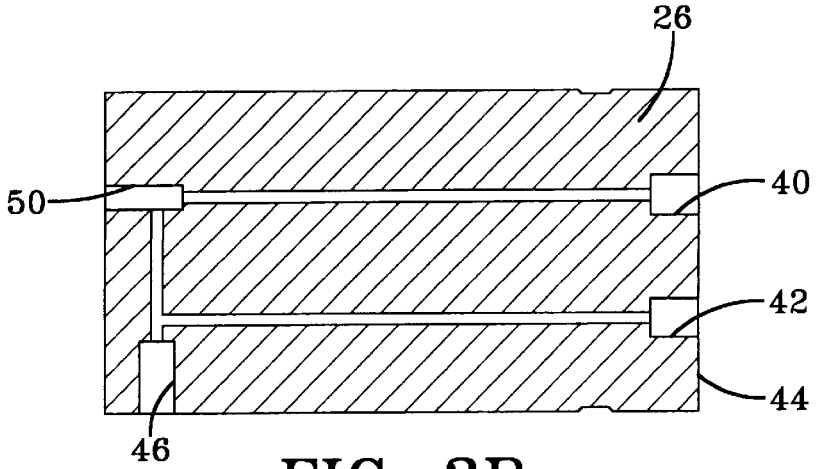

FIG. 3B illustrates another cross-sectional view of one embodiment of the nozzle of the present invention. Taken along cross-section B—B, FIG. 3B illustrates the bores or holes for creating the mist for the present invention. In the embodiment of FIG. 3B, the top bore 40 is for receiving compressed air. The bottom bore 42 is for receiving water. The water and air are preferably received at the back 44 of the nozzle. In one embodiment, the water and air lines, not shown, flow from the nozzle, through the main body portion, down the stand portion to the water and air sources. In the embodiment of FIGS. 3A and 3B, the water is not under pressure. In an alternative embodiment, mist is directly supplied to the gun from an external source.

The top bore 40 is preferably wider toward the front of the nozzle which creates an area of low pressure. This creates a vacuum for sucking the water into the top bore from the bottom bore. As the water is drawn into the top bore, the pressurized blows the water out the front of the nozzle causing a mist as the water leaves the nozzle. As the laser hits the mist, the laser light is illuminated. The laser path from the gun to the target may be entirely illuminated (based on amount of mist output and the distance to the target) as the laser light interacts with the spray mist. A bore 46 at the bottom of the nozzle is provided for access purposes.

FIGS. 3A and 3B illustrate the holes 48, 50 in the front of the nozzle where the laser output and mist leaves the nozzle, respectively. In one embodiment, the nozzle incorporates a light effect. LEDs are attached at, preferably, the rear of the nozzle. Shown generally at 52. In this embodiment, the nozzle is made from a clear material, such as clear, glass, plastic or plexiglass. The front of the nozzle may be covered with a mirror decal with appropriate holes for the laser output and the mist. The mirror decal, shown generally at 54, enhances the light in the clear plastic nozzle and may prevent the LEDs from activating a light-sensitive target.

In the preferred embodiment, a check valve, shown generally at 58, acts to prevent water in the bore holes in the nozzle from receding back to the water source at the end of a race (e.g., with the laser and air supply turned off). Without the check valve, the water in the gun would recede back to the water reservoir at the end of a race and there would be no water immediately available at the gun nozzle for the next race.

Figure 4:
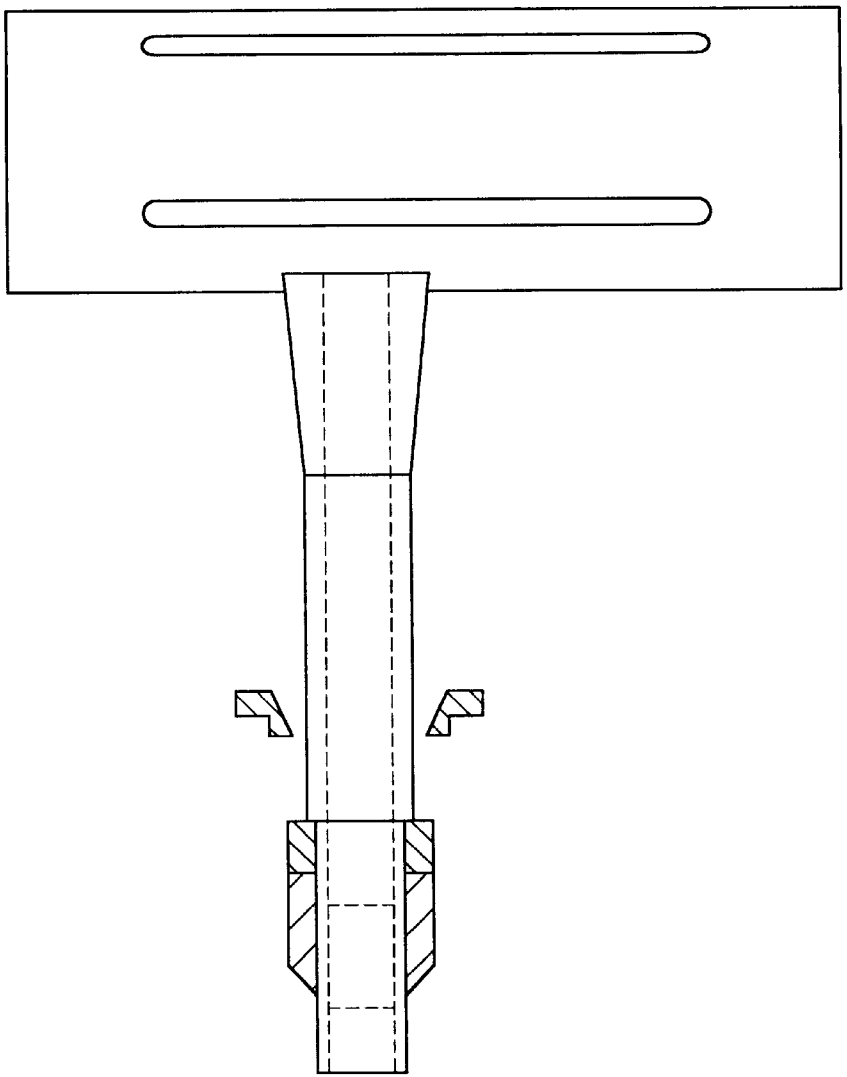
FIG. 4 illustrates a side elevational view of one embodiment of the main body assembly of the present invention.
Figure 5:
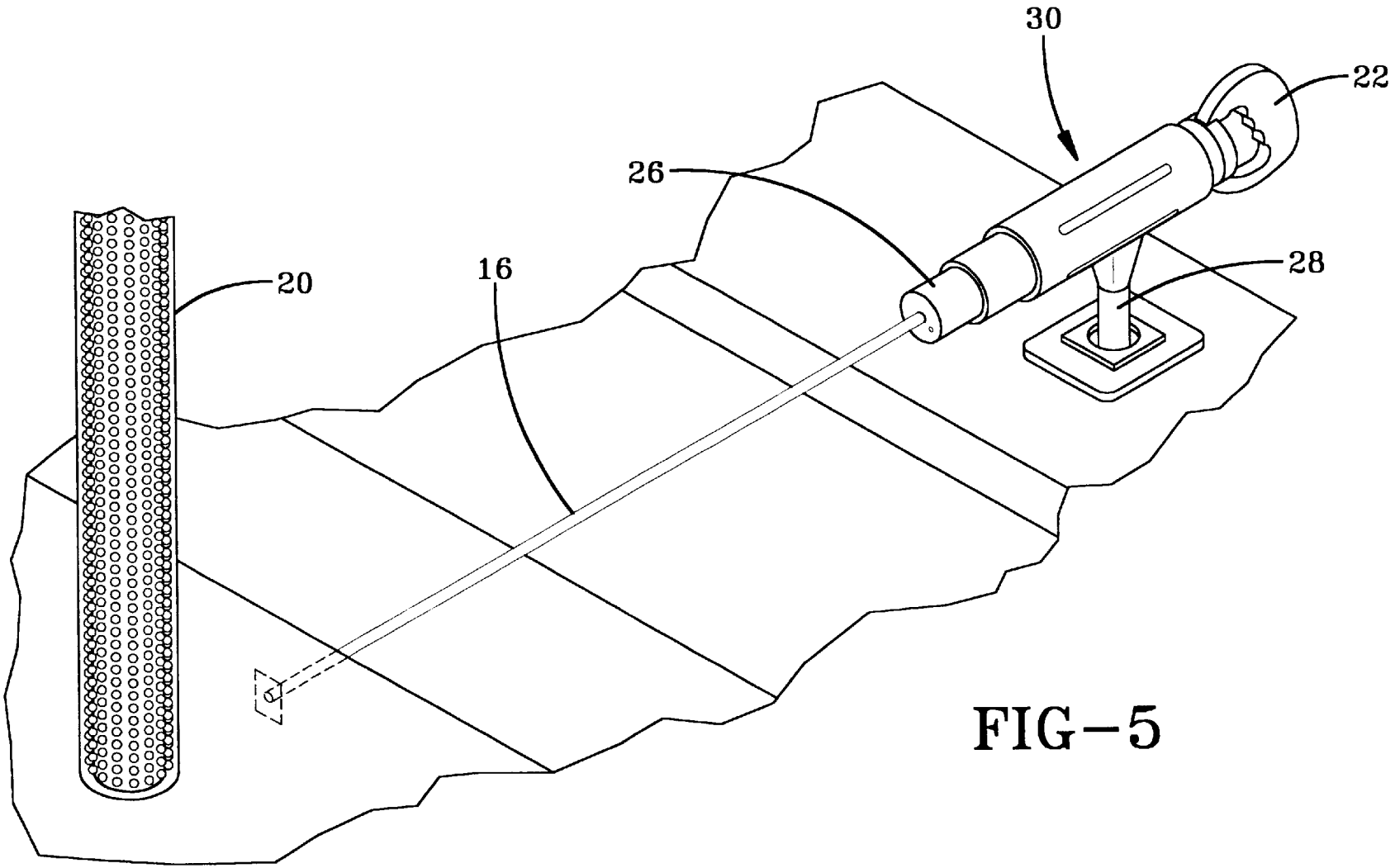
FIG. 5 illustrates one embodiment of the laser gun of the present invention in operation.

FIG. 4 illustrates a side elevational view of one embodiment of the main body assembly of the present invention. FIG. 5 illustrates one embodiment of the laser gun of the present invention in operation.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

We claim:

1. In a racing type arcade game having a shooting apparatus and target, and wherein when said target is hit by shots from said shooting apparatus an indicia of racing progress is actuated to reach a predetermined progress level, the improvement comprising:

said shooting apparatus is a laser gun, wherein said laser gun has at least one hole for spraying a mist illuminated by said laser.

2. In a racing type arcade game having a shooting apparatus and target, and wherein when said target is hit by shots from said shooting apparatus an indicia of racing progress is actuated to reach a predetermined progress level, the improvement comprising:

said shooting apparatus is a laser gun, wherein said laser gun has at least a first hole and a second hole, said first hole providing an outlet from a first conduit for compressed air and said second hole providing an outlet from a second conduit for water to create a mist to be illuminated by said laser.

3. The laser gun of claim 2 wherein said second conduit includes at least one check valve.

4. In a racing type arcade game having a shooting apparatus and target, and wherein when said target is hit by shots from said shooting apparatus an indicia of racing progress is actuated to reach a predetermined progress level, the improvement comprising:

said shooting apparatus is a laser gun, wherein said laser gun is comprised of a nozzle comprised of a clear material including at least one LED mounted inside said nozzle to be viewed through said clear material.

5. In a racing type arcade game having a shooting apparatus wherein the improvement comprises:

a laser gun for an arcade game comprising:

a main body assembly having a first end;

a handle attached to said main body assembly;

a nozzle attached to said first end of said main body assembly; and a laser disposed in said nozzle, when actuated, to shoot through said nozzle and be aimed towards an arcade game target, wherein said nozzle has at least one hole for spraying a mist to be illuminated by said laser.

6. In a racing type arcade game having a shooting apparatus, wherein the improvement comprises:

a laser gun for an arcade game comprising:

a main body assembly having a first end;

a handle attached to said main body assembly;

a nozzle attached to said first end of said main body assembly; and a laser disposed in said nozzle, when actuated, to shoot through said nozzle and be aimed towards an arcade game target, wherein said nozzle has at least a first hole and a second hole, said first hole providing an outlet from a first conduit for compressed air and said second hole providing an outlet from a second conduit for water to create a mist to be illuminated by said laser.

7. The laser gun of claim 6 wherein said second conduit includes at least one check valve.

8. In a racing type arcade game having a shooting apparatus, wherein the improvement comprises:

a laser gun for an arcade game comprising:

a main body assembly having a first end;

a handle attached to said main body assembly;

a nozzle attached to said first end of said main body assembly; and a laser disposed in said nozzle, when actuated, to shoot through said nozzle and be aimed towards an arcade game target;

wherein said nozzle is comprised of a clear material; and wherein said nozzle includes at least one LED mounted inside said nozzle to be viewed through said clear material.

9. A laser gun for an arcade game comprising:

a main body assembly having a first end;

a handle attached to said main body assembly;

a nozzle attached to said first end of said main body assembly; and a laser mounted inside said laser gun, when actuated, to shoot through said nozzle and be aimed towards a target;

wherein said laser hitting said target actuates an indicator on said arcade game, said nozzle is comprised of a clear material, and said nozzle includes at least one LED mounted inside said nozzle to be viewed through said clear material.

10. The apparatus of claim 9 wherein said nozzle has at least one hole for spraying a mist to be illuminated by said laser.

* * * * *

UNITED STATES PATENT AND TRADEMARK OFFICE

CERTIFICATE OF CORRECTION

PATENT NO. : 6,733,013 B1
DATED : May 11, 2004
INVENTOR(S) : Bartels et al.

It is certified that error appears in the above-identified patent and that said Letters Patent is hereby corrected as shown below:

Column 2,
Line 35, please delete "pressurized blows" and insert -- pressurized air blows --.

Signed and Sealed this

Thirteenth Day of July, 2004

JON W. DUDAS
*Acting Director of the United States Patent and Trademark Office*